United States Patent [19]

Stepp et al.

[11] 3,946,271

[45] Mar. 23, 1976

[54] SCR STROBE LAMP CONTROL FOR PREVENTING CAPACITOR RECHARGE DURING AFTER-GLOW

[75] Inventors: Gregory Stepp; Michael Dennis Patrick, Sr., both of Urbana, Ohio

[73] Assignee: Grimes Manufacturing Company, Urbana, Ohio

[22] Filed: Dec. 26, 1974

[21] Appl. No.: 536,633

[52] U.S. Cl. ..... 315/241 S; 315/200 A

[51] Int. Cl.[2] ..... H05B 37/00

[58] Field of Search ..... 315/241 P, 241 R, 241 S, 315/200 A

[56] References Cited

UNITED STATES PATENTS 3,339,108 8/1967 Holtje ..... 315/241

*Primary Examiner*—John Kominski

*Attorney, Agent, or Firm*—Biebel, French & Nauman

[57] ABSTRACT

A strobe lamp power supply control circuit for use with a high intensity strobe lamp operating at a high flashing rate in parallel with a capacitor storage arrangement is disclosed. Strobe lamp after-glow is quickly eliminated after each flash. This is accomplished by providing an SCR which disconnects the power source from the capacitor storage arrangement and the strobe lamp for a sufficient time to allow the after-glow to dissipate. A zero crossing detector is provided to protect the SCR from surge currents by permitting the SCR to be gated on only when there is a zero potential across the terminals of the SCR. Additionally, the capacitor storage arrangement may be used to supply either of two strobe lamps when a voltage limiting circuit is activated to regulate the amount of energy stored.

14 Claims, 3 Drawing Figures

SCR STROBE LAMP CONTROL FOR PREVENTING CAPACITOR RECHARGE DURING AFTER-GLOW

BACKGROUND OF THE INVENTION

This invention relates to an apparatus for control of a strobe lamp. Strobe lamps of the type sought to be controlled typically comprise a chamber in which there are two power electrodes and a gas which is capable of ionization. Typically the strobe lamp has a large potential placed across the two electrodes. When the firing of the lamp is desired, a firing pulse will be applied to a third electrode, the firing or trigger electrode. This firing pulse will ionize the gas sufficiently to allow current to flow between the two power electrodes with the result that the strobe lamp is flashed. The power supply for this type of lamp is generally a bank of capacitors in parallel with the lamp.

One problem that is prevalent in controlling this sort of lamp is that, after the lamp is flashed, the gas in the lamp will remain ionized in an effect called "after-glow". A strobe lamp experiencing after-glow cannot be flashed. If the capacitor bank is recharged while the strobe lamp is experiencing after-glow, the after-glow effect will be perpetuated and therefore further firing of the strobe lamp will be prevented.

One approach to solving the after-glow problem has been to utilize a sufficiently weak voltage source to recharge the capacitor bank such that the charging rate of the capacitor bank is less than the discharge rate of the strobe lamp experiencing after-glow. The capacitor bank will then discharge through the strobe lamp until the voltage across the lamp drops below the minimum conduction voltage of the lamp. When this occurs, the after-glow will terminate and the capacitor bank may then be recharged.

Where a high intensity strobe lamp requiring a great deal of power is to fired at a fairly rapid rate, as for example an aircraft anti-collision light, a powerful voltage supply is needed to recharge rapidly the capacitor bank. Such a voltage supply will charge the capacitors and maintain the strobe lamp in its after-glow condition, thus preventing the lamp from being fired. The varying ambient temperatures to which aircraft strobe lamps are subjected can accentuate this problem. For example, in a cold environment, the after-glow effect will more readily occur and will persist for a greater length of time.

An additional problem encountered with aircraft strobe lamp arrangements is that quite often more than one set of strobe lamps is desired to be flashed. Typically one set of lamps will be used during the day and a second set of lamps, having different energy requirements, will be used at night. In the past a separate capacitor bank has been used for each set of strobe lamps to compensate for the varying energy requirements. Such an arrangement is wasteful of space and weight and is thus disadvantageous in an aircraft application.

SUMMARY OF THE INVENTION

This invention relates to an improved circuit for control of the firing of a strobe lamp for insuring that the gas in the strobe lamp has completely returned to its non-ionized state before an attempt is made to recharge the means supplying power to the strobe lamp. This is accomplished by use of a capacitor means for storing a charge to be supplied to the strobe lamp; a means for charging this capacitor means; and a circuit means, connected between the capacitor means and the means for charging, for preventing application of power to the capacitor means once the strobe lamp is fired and for a predetermined period of time thereafter, this period of time being sufficient to allow for complete extinguishment of the strobe lamp. The circuit means may include a switching circuit. A timing means is provided which supplies a pulse of predetermined duration to the switching circuit at the same time that it supplies a firing pluse to the strobe lamp. The switching circuit then disconnects the means for charging from the capacitor means during receipt of this pulse of predetermined duration.

The switching circuit preferably includes a silicon controlled recitifier (SCR) which is capable of being switched off at appropriate times. The SCR is connected in series with the means for charging so that when the SCR is switched off, no power is applied to either the strobe lamp or to the capacitor means. The duration of the pulse supplied by the timing means to the switching means is set so that there is sufficient time for the ionized gas in the strobe lamp to return to its non-ionized state. The duration of this pulse may be additionally increased in order to reduce the charging time of the capacitor means and thus reduce the amount of energy stored in the capacitor means and supplied to the strobe lamp. After this predetermined period of time, the SCR is turned on and the capacitor means is allowed to recharge in anticipation of the next firing pulse.

The switching means may further comprise a means for preventing application of gate drive to the SCR, after the strobe lamp gas has returned to its non-ionized state, until the potential across the SCR is at a zero level. This prevents damage to the SCR from surge currents which would occur if the SCR were turned on with a large potential across it.

A voltage limiter means monitoring the voltage stored by the capacitor means may be further provided to switch the SCR off and thus prevent further charging of the capacitor means when a selected one of a plurality of voltage levels is reached. A selector means, connected to the voltage limiter means, selects one of the plurality of voltage levels. Such an arrangement allows a number of sets of strobe lamps, each having its own energy requirements, to be supplied by a single capacitor means.

The timing means includes a counter connected to a firing circuit. The counter supplies a pulse of predetermined duration to the firing circuit and to the switching means. The firing circuit supplies a firing pulse of short duration to the strobe lamp on receipt of the leading edge of the pulse of predetermined duration.

Accordingly, it is an object of this invention to provide an improved strobe lamp control circuit wherein reapplication of power to the capacitor means, after the strobe lamp is flashed, is prevented for a time sufficient to allow the gas in the strobe lamp to return completely to its non-ionized state.

Also, it is an object of this invention to provide an improved strobe lamp control circuit wherein reapplication of power to the capacitor bank after the strobe lamp is flashed is prevented for a time sufficient to allow the gas in the strobe lamp to return completely to its non-ionized state and wherein the control circuit utilizes a single SCR to control application of power.

It is an object of this invention to provide an improved strobe lamp control circuit wherein reapplication of power to the capacitor means after the strobe lamp is flashed is prevented for a time sufficient to allow the gas in the strobe lamp to return completely to its non-ionized state, and wherein an SCR semiconductor device used in the preferred embodiment of this invention is protected by a providing gate drive thereto only when the potential across the SCR is zero.

Further, it is an object of this invention to provide an improved strobe lamp control wherein a single capacitor storage bank may be used to supply energy to a plurality of sets of strobe lamps, each set having different energy requirements.

These and other objects and advantages of the invention will be apparent from the following description, the accompanying drawings and the appended claims.

DESCRIPTION OF THE PREFERRED EMBODIMENT

Figures 1, 2:
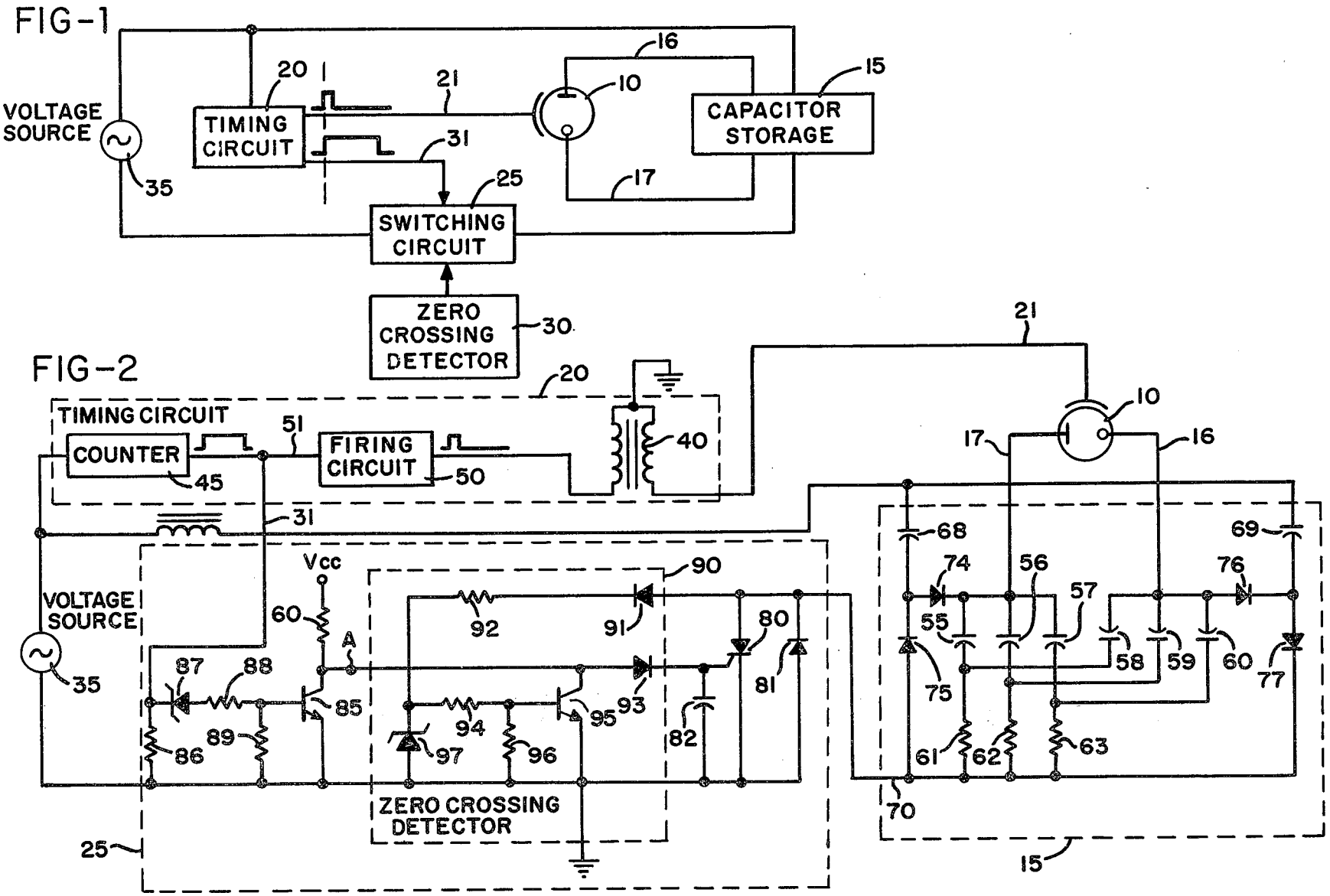
FIG. 1 is a block diagram representation of the preferred embodiment of the instant invention.
FIG. 2 is a more detailed schematic drawing of the preferred embodiment of the instant invention.

Referring now to FIG. 1 of the drawings, where a diagramatic representation of the preferred embodiment of the invention is shown, strobe lamp 10 is connected to capacitor storage means comprising capacitor storage 15 which supplies the power to strobe lamp 10 via lines 16 and 17. Firing of the strobe lamp 10 is controlled by the timing circuit 20 by application of a firing pulse of short duration to the strobe lamp 10 via line 21. This firing pulse ionizes the gas in the strobe lamp 10 sufficiently to allow the capacitor storage 15 to discharge through the lamp. After the strobe lamp 10 is fired, the capacitor storage 15 must be recharged in preparation for the next successive firing. Immediately after strobe lamp 10 is fired, however, the lamp 10 may experience an after-glow effect in which some of the gas in the lamp remains ionized for a time. If a voltage is applied to the lamp 10 in this state, a current will flow and the gas in the lamp 10 will continue to remain ionized. Since strobe lamp 10 cannot be refired while experiencing after-glow, a momentary interruption of power is provided so as to permit the gas in the strobe lamp 10 to return to a non-ionized state in preparation for the next firing pulse.

This interruption is accomplished in the preferred embodiment of the invention by use of circuit means for preventing application of power to the capacitor storage from the means for charging comprising switching circuit 25 and zero crossing detector 30. Switching circuit 25 opens for the duration of the pulse supplied by timing circuit 20 via line 31. As shown in FIG. 1, the pulse on line 31 is supplied simultaneously with the firing pulse on line 21, but is of greater length. The duration of the pulse on line 31 is set so as to be sufficient to allow the ionized gas in lamp 10 to return to its non-ionized state. After the termination of the pulse supplied on line 31, the switch 25 will reconnect the voltage source 35 to the capacitor storage 15 when the potential across switching circuit 25 reaches its next null. This condition is detected by zero crossing detector 30. Zero crossing detector 30 prevents damage to switching circuit 25 from surge currents which would occur if switching circuit 25 were switched on with a large potential existing across the switching circuit terminals.

Referring now to FIG. 2, the preferred embodiment of the instant invention is shown in greater detail. Lamp 10 is fired by means of a pulse from pulse transformer 40 in timing circuit 20. Timing circuit 20 also may include a counter 45 and a firing circuit 50. The counter counts the successive cycles of alternating voltage source 35 and supplies a pulse on line 51 after a predetermined number of alternations. This same result could be accomplished in a variety of ways, as for example by means of a multivibrator. The firing circuit 50 supplies a pulse to pulse transformer 40 on receipt of the leading edge of the pulse on line 51.

Capacitor storage circuit 15 comprises charging capacitors 55 through 60. These capacitors are charged by voltage source 35 through inductor 65 which is placed in the circuit to control the initial charging current supplied to the capacitors. Charing of capacitors 55 through 60 is accomplished by the use of voltage multiplier capacitors 68 and 69. Capacitor 68 is used to charge storage capacitors 55 through 58 to twice the peak potential of the voltage source 35. Similarly, capacitors 58, 59, and 60 are charged through voltage multiplier capacitor 69 and diodes 76 and 77 to twice the voltage potential of voltage source 35. It can be seen that capacitors 55 through 57 are in series with capacitors 58 through 60, so that the strobe lamp 10 is presented with a charge of four times that of the peak voltage of source 35.

Switching circuit 25 comprises SCR 80 and diode 81, through which charging of the capacitor storage circuit 15 is accomplished. Assuming there is no pulse on line 31, the gate electrode of SCR 80 sees a positive potential from $V_{cc}$ and SCR 80 is thus switched on. At the time that strobe lamp 10 is fired, however, a pulse of predetermined duration appears on line 31. This pulse causes transistor 85 to be switched on and the gate current of SCR 80 is thus reduced to zero. As the voltage across SCR 80 drops to zero and below, the anode of SCR 80 is starved of anode current. The combination of no anode current and no gate current will switch SCR 80 off. When SCR 80 is switched off, capacitors 68 and 69 are not able to charge and discharge but are only able to charge. Therefore, capacitors 68 and 69 cannot pass current. This effecfively opens the charging path to capacitors 55 through 60 from voltage source 35. SCR 80 will not conduct again until gate drive is reapplied and this will not occur until transistor 85 is switched off. Transistor 85, in turn, will not switch off until the pulse applied by counter 45 on line 31 is terminated.

Even after the termination of the pulse applied by counter 45 to line 31, however, the gate drive to SCR 80 will not be reapplied until the zero crossing detector circuit 90 determines that a zero potential exists across SCR 80. The zero crossig detector circuit 90 exists in order to protect SCR 80 from any damage which could result from turning SCR 80 on with a large potential across the semiconductor. The zero crossing detector circuit operates as follows. When SCR 80 is on, of course, no signal will be applied to the base of transistor 95. When, however, SCR 80 has been switched off, an alternating potential will exist across the SCR. A base current will then be applied to transistor 95 to turn the transistor on and this will effectively remove any gate current from SCR 80. When the potential across SCR 80 drops to zero, no base current is applied to the transistor 95 and the transistor 95 will switch off. Therefore, if the pulse on line 31 has terminated so that transistor 85 has switched off and, further, if transistor 95 has also switched off due to a zero potential across SCR 80, then a gate current will be applied to SCR 80 and the SCR will then begin to conduct as the voltage across it increases.

Thus, it is seen that the charging of capacitor storage circuit 15 is interrupted directly after firing of lamp 10 for a period of time determined by the duration of the pulse provided by counter 45. This period of time is set so as to allow the gas in the strobe lamp 10 to return to its non-ionized state. The pulse of predetermined duration supplied by counter 45 cannot extend beyond a certain maximum period of time, however. This maximum period of time is a function of the length of time needed to recharge the capacitors 55 through 60 and also a function of the length of time between successive firing pulses. thus if the pulse of predetermined duration supplied by counter 45 is too long, the capacitors 55 through 60 will not have sufficient time to recharge completely after the pulse of predetermined duration terminates and before the next successive firing pulse.

This feature may be used advantageously to limit the amount of energy stored by the storage capacitor bank 15. The longer the capacitor storage bank 15 is disconnected from the voltage source, the less time will be available for charging and consequently a lesser amount of energy will be stored. Although the circuit generally operates with a constant length pulse of predetermined variation, pulse length may be adjusted at the factor for a particular application. This adjustment may be provided for by including a monostable multivibrator in the output of the counter. Such a multivibrator generally has its pulse length set by externally connected impedances which may easily varied until the capacitor storage charges to the desired energy level. Typically the off time of SCR 80 may approximate 70 milliseconds to insure the elimination of after-glow. Off times as short as 40 milliseconds have been used, however.

Figure 3:
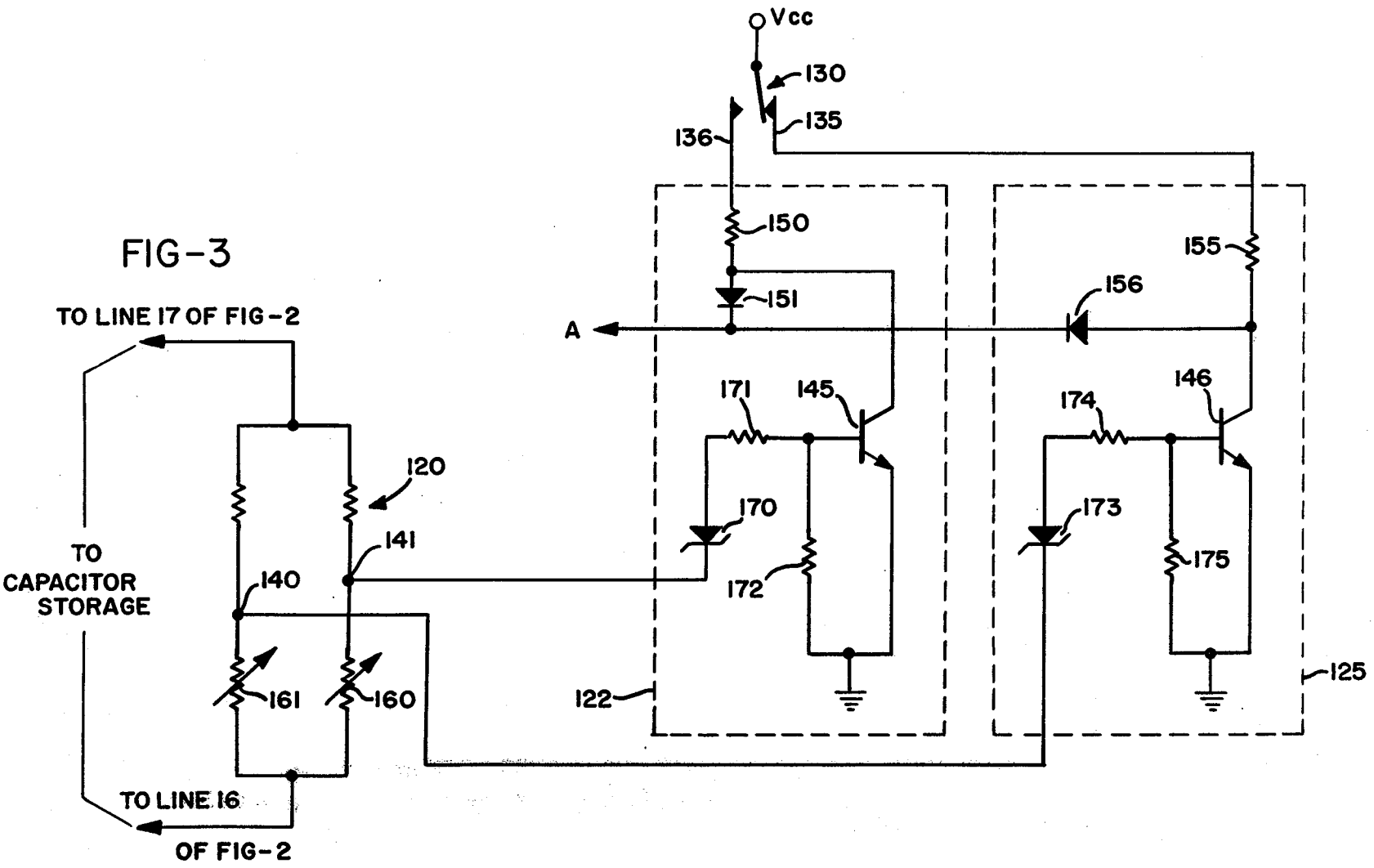
FIG. 3 is a schematic drawing of a circuit modification of the preferred embodiment of the instant invention.

Referring now to FIG. 3 of the drawings, a circuit arrangement is shown for modification of the preferred embodiment of the invention. Quite often in aircraft applications of the instant invention, more than one set of strobe lamps will be used. A set of lamps requiring 90 joules of energy may be flashed at night while a 40 joule set of strobe lamps may be used for daytime operation. Since, $$J = \tfrac{1}{2}CV^2$$

where, $J$ = energy in joules, $C$ = capacitance in farads, and $V$ = potential in volts, the amount of energy stored may be determined by measuring the voltage across the capacitor bank. Where a 600 $\mu$fd capacitor bank is utilized, 90 joule operation would require a charge of 537 volts and 40 joule operation would require a charge of 365 volts.

When the circuit of FIG. 3 is placed into the circuit of FIG. 2 as indicated, operation at two such energy levels is possible. Line A of the circuit of FIG. 3 is connected to node A in FIG. 2 and resistor 60 is disconnected from the collector terminal of transistor 85. Voltage divider arrangement 120 is then connected across the output of capacitor storage 15 by connecting to lines 16 and 17 to FIG. 2 as indicated. When connected in this manner circuit 122 will be used for operation with lamps requiring a first level of energy and circuit 125 will be used for operation with lamps requiring a second level of energy.

When energized via switch 130, these circuits detect the storage of desired voltage on capacitor storage 15 and thus the storage of the desired amount of energy, as explained previously. When the desired potential is reached, node 140 or 141 will be raised in potential sufficiently to trigger on either transitor 145 or transistor 146. When this occurs, the gate drive which would normally be supplied to SCR 80 by way of resistor 150 and diode 151 or resistor 155 and diode 156 will be eliminated. Transistors 145 and 146, when on, act to short out the gate drive circuit of SCR 80 and thus prevent application of power to capacitor storage 15. When the capacitor storage 15 has reached its desired energy level, and is awaiting discharge through strobe lamp 10, the storage capacitors may experience some leakage. This will be detected by the voltage limiters, and the charging current reapplied to the capacitor storage as necessary to maintain the appropriate energy level.

While the form of apparatus herein described constitutes a preferred embodiment of the invention, it is to be understood that the invention is not limited to this precise form of apparatus and that changes may be made therein without departing from the scope of the invention which is defined in the appended claims.

What is claimed is:

1. In a system for controlling the successive firing and extinguishment of a strobe lamp to insure complete extinguishment of said strobe lamp, the combination comprising capacitor means for storing a charge to be supplied to said strobe lamp;

alternating current source means for charging said capacitor means; and circuit means, connected in series with said capacitor means and said means for charging, conductive prior to each firing of said strobe lamp for transmitting power from said means for charging to said capacitor means and nonconductive at the time of firing said strobe lamp and for a predetermined period thereafter for preventing application of power to said capacitor means from said means for charging, said predetermined period being sufficient to allow for complete extinguishment of said strobe lamp.

2. The combination of claim 1 further comprising:

timing means for supplying a pulse of short duration to said strobe lamp and for providing a pulse of fixed duration to said circuit means, said fixed duration being a period of time sufficient to allow said strobe lamp to extinguish completely when power is removed therefrom.

3. The combination of claim 1 further comprising:

timing means for supplying a pulse of short duration to said strobe lamp and for providing a pulse of fixed duration to said circuit means, said fixed duration being a period of time sufficient to allow said strobe lamp to extinguish completely when power is completely removed therefrom and to prevent said capacitor means from storing more than a desired amount of energy prior to the time of firing of said strobe lamp.

4. The combination of claim 1 wherein said circuit means comprises switching means connected in series with said capacitor means.

5. The combination of claim 4 wherein said switching means comprises a silicon controlled rectifier.

6. The combination of claim 5 wherein said circuit means further comprises zero crossing detection means for preventing said silicon controlled rectifier from conducting power to the capacitor means until the voltage potential across said silicon controlled rectifier has reached a zero potential state.

7. The combination of claim 1 further comprising:

voltage limiter means responsive to the voltage stored by said capacitor means for sensing when the voltage stored by said capacitor means reaches one of a plurality of voltage levels and for supplying an output to said circuit means so as to control the amount of energy stored by said capacitor means.

8. A strobe lamp system for insuring complete extinguishment of a strobe lamp after firing comprising:

a. a strobe lamp, b. a source of a.c. power, c. means for storing energy connected in parallel with said strobe lamp and further connected to said power source, d. timing means for supplying a pulse of short duration to said strobe lamp, and for providing a pulse of fixed duration, and e. switching means, connected in series with said means for storing energy and said power source, conductive prior to each firing of said strobe lamp for transmitting power from said source of a.c. power to said means for storing energy and non-conductive in response to said pulse of fixed duration for disconnecting said source of a.c. power from said means for storing energy for the duration of said pulse of fixed duration so that said strobe lamp is deprived of power for a period of time sufficient to insure complete extinguishment.

9. The strobe lamp system of claim 8 wherein said switching means comprises means for allowing reconnection of said power source to said means for storing energy only when the potential across said switching means is at a zero level.

10. The strobe lamp system of claim 8 wherein the duration of said pulse of fixed duration is such that said means for storing energy is permitted to store only a desired amount of energy.

11. The strobe lamp system of claim 9 wherein said timing means comprises means, responsive to the output of said power source, for providing said pulse of fixed duration after the occurrence of a predetermined number of alternations in the ouptut of said power source.

12. The strobe lamp system of claim 8 wherein said switching means comprises a silicon controlled rectifier, and first control means connected to the gate of said silicon controlled rectifier for removing the gate current and gate voltage in response to said pulse of fixed duration.

13. The strobe lamp system of claim 12 wherein said switching means further comprises a second control means for preventing application of said gate current and gate voltage until the potential across said silicon controlled rectifier is at a zero level.

14. The strobe lamp system of claim 13 further comprising:

voltage limiter means, responsive to the voltage stored by said means for storing energy, for preventing application of said gate current and said gate voltage after the voltage stored by said means for storing energy reaches a selected one of a plurality of voltage levels, and selector means, connected to said voltage limiter means, for selecting one of said plurality of voltage levels.

* * * * *